US006179011B1

(12) United States Patent
de Jager

(10) Patent No.: US 6,179,011 B1
(45) Date of Patent: Jan. 30, 2001

(54) APPARATUS FOR THE INSERTION OF WEFT THREADS FOR A SERIES SHED WEAVING MACHINE AND A SERIES SHED WEAVING MACHINE WITH AN APPARATUS

(75) Inventor: Godert de Jager, Volketswil (CH)

(73) Assignee: Sulzer Rueti AG, Rueti (CH)

( * ) Notice: Under 35 U.S.C. 154(b), the term of this patent shall be extended for 0 days.

(21) Appl. No.: 09/365,433

(22) Filed: Aug. 2, 1999

(30) Foreign Application Priority Data

Aug. 19, 1998 (EP) ..... 98810807

(51) Int. Cl.[7] ..... D03D 47/30; D03D 47/00
(52) U.S. Cl. ..... 139/28; 139/450
(58) Field of Search ..... 139/28, 450, 435.1

(56) References Cited

U.S. PATENT DOCUMENTS 4,592,393 * 6/1986 Steiner ..... 139/28
5,146,955 * 9/1992 Steiner et al. ..... 139/28
5,406,985 * 4/1995 Christe ..... 139/28
5,439,037 * 8/1995 Christe ..... 139/28
5,632,308 * 5/1997 Bucher et al. ..... 139/28
5,937,913 * 8/1999 Christe ..... 139/28

FOREIGN PATENT DOCUMENTS

0143860A1 6/1985 (EP) .
0433216A1 6/1991 (EP) .
0685584A1 12/1995 (EP) .

* cited by examiner

*Primary Examiner*—Andy Falik
(74) *Attorney, Agent, or Firm*—Townsend and Townsend and Crew LLP

(57) ABSTRACT

An apparatus for the insertion of weft threads contains a stationary unit having an arrangement with a plurality of passages, a plurality of nozzles for the supplying of weft threads and a unit which rotates with the weaving rotor with a plurality of injector nozzles which are intended to successively draw off the weft threads which are supplied to the passages and to feed them into the shed.

13 Claims, 4 Drawing Sheets

APPARATUS FOR THE INSERTION OF WEFT THREADS FOR A SERIES SHED WEAVING MACHINE AND A SERIES SHED WEAVING MACHINE WITH AN APPARATUS

BACKGROUND OF THE INVENTION

1. Field of the Invention

The invention relates to of weft threads in accordance with the preamble of claim 1 and to a series shed weaving machine with an apparatus.

2. Description of the Prior Art

An apparatus is described in EP-A-0 433 216 for the distribution of the weft threads from a thread supply device to a plurality of insertion passages of a weaving rotor of a series shed weaving machine which contains a stationary part, and a part which rotates with the weaving rotor which have a common separation and sealing surface in a rotationally symmetrical surface and via which the transfer of the weft threads takes place. In the stationary part passages are formed in a known arrangement and nozzles are provided for each passage in order to draw off the weft threads from a device which supplies the weft threads and to introduce them into the respective passage. In the part which rotates with the weaving rotor, acceptor passages are formed in a known arrangement and shoot-in tubes are provided in order to shoot the weft threads which are supplied by the nozzles into the weft passages which are formed at the weaving rotor.

The disadvantages of this apparatus are essentially to be seen wherein the gap between the stationary part and the part which rotates with the weaving rotor is made very narrow in order to ensure the forwarding of the weft threads to the weaving rotor, in that the nozzle which is associated with each passage must drive the start of the weft thread through the passage up to the relay nozzles in the weaving rotor; and wherein as a result of the constitution of the yarn, thread parts, e.g. fibrils can penetrate into the gap between the stationary part and the part which rotates with the weaving rotor. A substantial restriction of the types of yarn which can be woven on the weaving machine results from this.

SUMMARY OF THE INVENTION

The object of the invention is to improve an apparatus of this kind.

Because the weft threads are prepared in a stationary unit with supply nozzles and are shot into the weft passages by means of a unit with injector nozzles which rotates with the weaving rotor, there results the advantage that different yarn sorts, in particular also filament yarns, can be shot into the weft passage in a disturbance-free manner.

The weaving machine has the advantage that as a result of a discontinuous supply of the weft threads there exists the possibility of selecting the available weft yarn freely and in accordance with a predetermined program for the weft insertion.

DETAILED DESCRIPTION OF THE PREFERRED EXEMPLARY EMBODIMENTS

Figure 1:
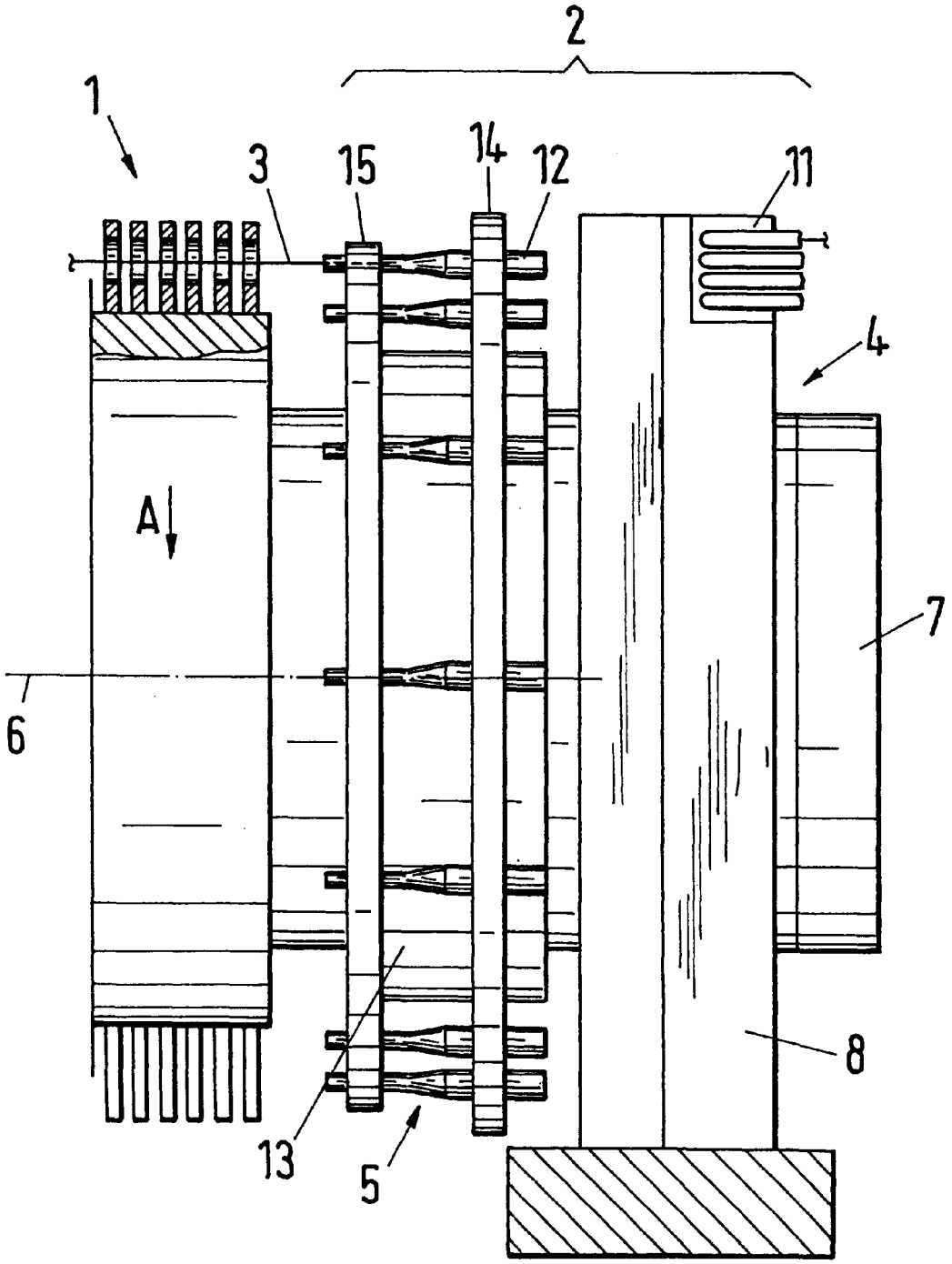
FIG. 1 is a side view of an embodiment of an apparatus in accordance with the invention.

FIG. 1 shows a weaving rotor 1 and an apparatus 2 in accordance with the invention for the insertion of weft threads 3 for a series shed weaving machine.

The apparatus 2 comprises a stationary unit 4 for the supplying of the weft threads, a unit 5 for feeding in the weft threads which rotates synchronously with the weaving rotor 1 about the axis of rotation 6 in the direction of the arrow A, and a rotary slide valve 7 for the supplying of the air. The unit 4 for the supplying of the weft threads has a holder 8 for an arrangement 11 of passages. The unit 5 for the feeding in of the weft threads has twelve injector nozzles 12 which are arranged on a cylindrical carrier part 13. The carrier part contains a first ring-shaped section 14 for the nozzle bodies and a second ring-shaped section 15 for the nozzle mouths. It is pointed out that the nozzles can be arranged in a common section and that the number of nozzles can vary.

Figure 2:
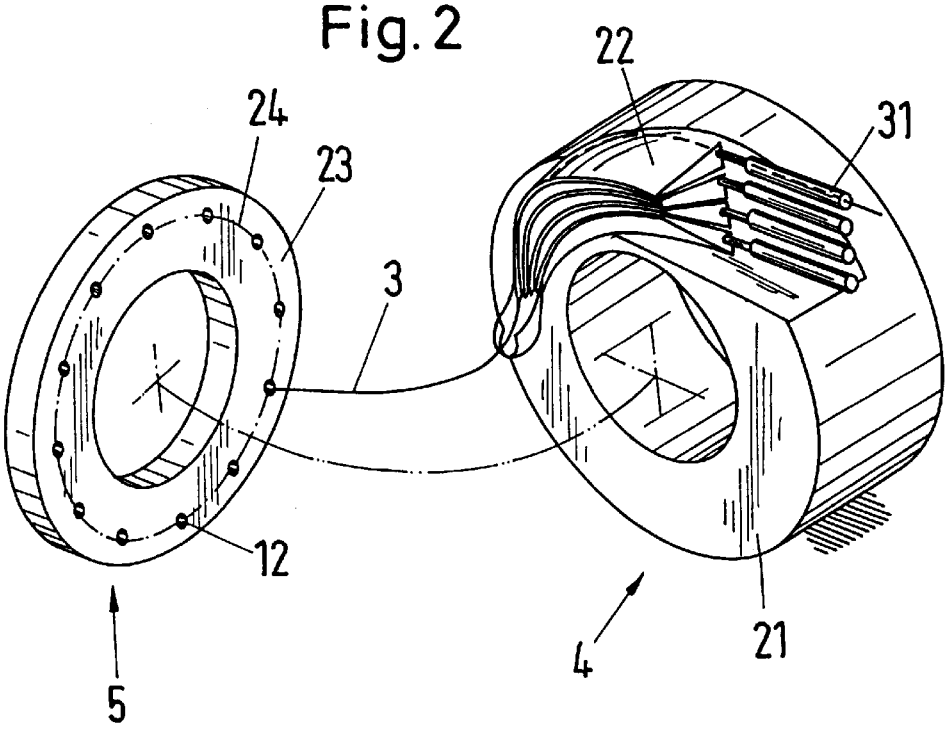
FIG. 2 is a schematic illustration of the stationary unit and the rotating unit in accordance with FIG. 1 at the beginning of the weft insertion.
Figure 3:
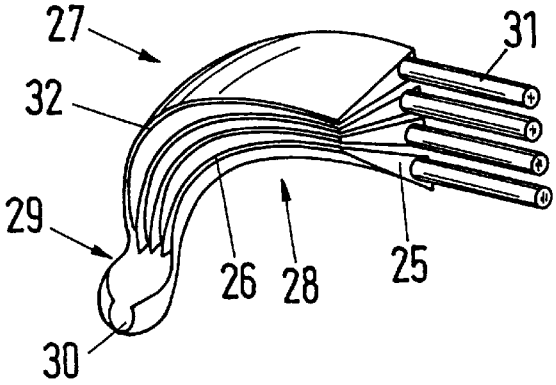
FIG. 3 is an embodiment of a component with a passage arrangement in accordance with the invention in a spatial illustration.
Figure 4:
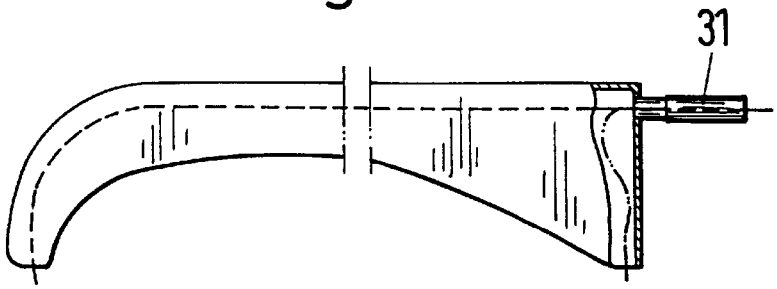
FIG. 4 is the component in accordance with FIG. 3 in an extended illustration.

Reference is made to FIGS. 2 to 4. As FIG. 2 shows (in a folded out illustration), the apparatus contains the stationary unit 4 for the supplying of the weft threads and a unit 5 for feeding in the weft threads which rotates synchronously with the weaving rotor 1. The unit 4 for the supplying of the weft threads 3 contains a holder 21 and an arrangement 22 which is mounted on the holder. The unit 5 for the feeding in of the weft threads 3 comprises a cylindrical carrier part 23 and twelve injector nozzles 12, the inlet and outlet of which lie on the same pitch circle 24.

As FIG. 3 shows, the arrangement 22 comprises four units 25 which form passages 26 and are arranged in the manner of a fan. A component 27 consists of a first section 28 with the units 25 and a second section 29 which is connected to the units and which has an opening 30. A nozzle 31 for the supplying of a weft thread is associated with each passage 26. Each passage 26 has a cross-section which continuously contracts in the direction of the axis of rotation 6 so that a gap 32 for the drawing out of the weft thread is formed.

The injector nozzles 12 are arranged to lie at equal distances on a pitch circle 41 in such a manner that the inlet of the injector nozzle and the opening 30 of the section 29 are directed towards one another during the takeover of a weft thread 3. The inlet of the injector nozzle is advantageously expanded in the shape of a funnel in order to ensure the acceptance of the weft thread.

FIG. 4 shows the component 27 in accordance with FIG. 3 in an extended illustration. In order to reduce the stressing of the weft threads during the drawing out from the passage 26 and the insertion into the shed it can be advantageous to design the depth of the passage 26 differently in accordance with the illustration.

Figure 6:
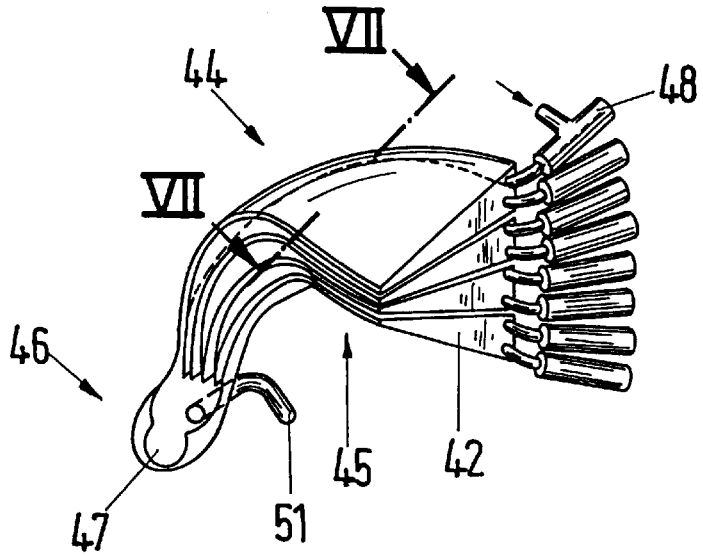
FIG. 6 is a second embodiment of a component with a passage arrangement in accordance with the invention in a spatial illustration.
Figure 7:
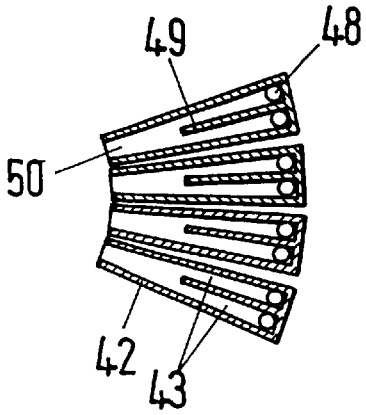
FIG. 7 is a section along the line VII—VII in FIG. 6.

Reference is made to FIGS. 6 and 7. These figures show another embodiment of the arrangement with four units 42 which form two passages 43 each and are arranged in the manner of a fan. The arrangement is designed as a component 44 and consists of a first section 45 with the units 42 and a second section 46 which is connected to the units and has an opening 47. A nozzle 48 for the supplying of a weft thread is associated with each passage 43. The two passages 43 of each unit are separated by an intermediate wall 49 and form a common gap 50 in order to draw out a weft thread. Furthermore, an auxiliary nozzle 51 is provided which is arranged in the second section 46 of the component 44 in such a manner that the opening of the auxiliary nozzle is directed towards the opening 47.

Figure 8:
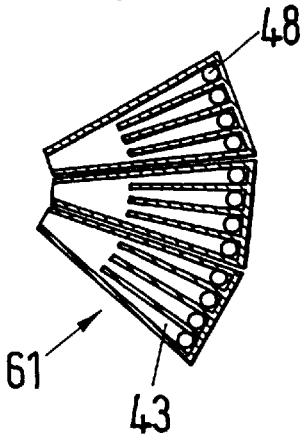
FIG. 8 is a cross-section of another embodiment of a passage arrangement.

FIG. 8 shows a unit 61 with four passages 43. It is pointed out that the number of the passages 43 can vary.

Figure 9:
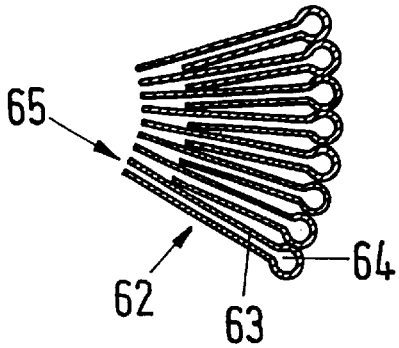
FIG. 9 is a cross-section of a further embodiment of a passage arrangement.

FIG. 9 shows eight units 62 which in each case form a passage 63, with each passage consisting of a transport passage 64 and a draw-out passage 65.

Figure 10:
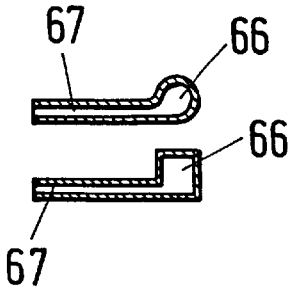
FIG. 10 is cross-sections of passages.

FIG. 10 shows cross-sectional forms of embodiments of units, with each passage consisting of a transport passage 66 and a draw-out passage 67.

Figure 11:
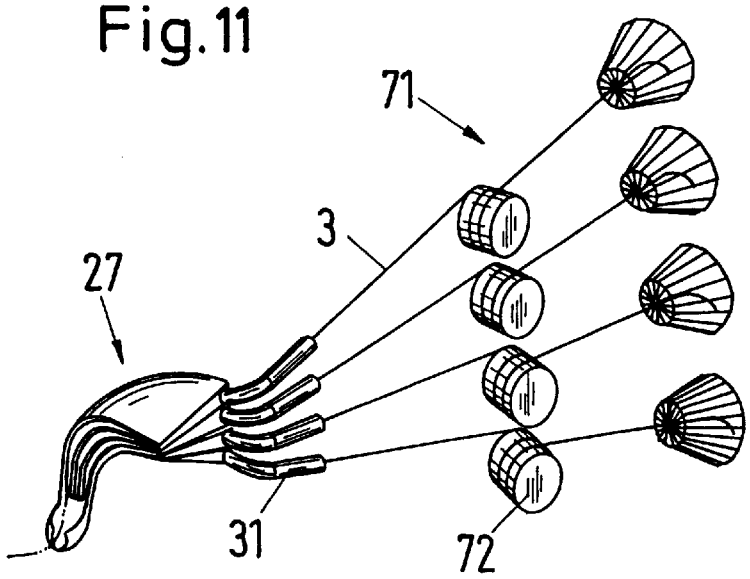
FIG. 11 is an embodiment of a device for the continuous supplying of weft threads and FIG. 12 is an embodiment of a device for the discontinuous supplying of weft threads

FIG. 11 shows a device 71 for the continuous supplying of weft threads 3 with a thread forwarding apparatus 72 for each nozzle 31.

Figure 12:
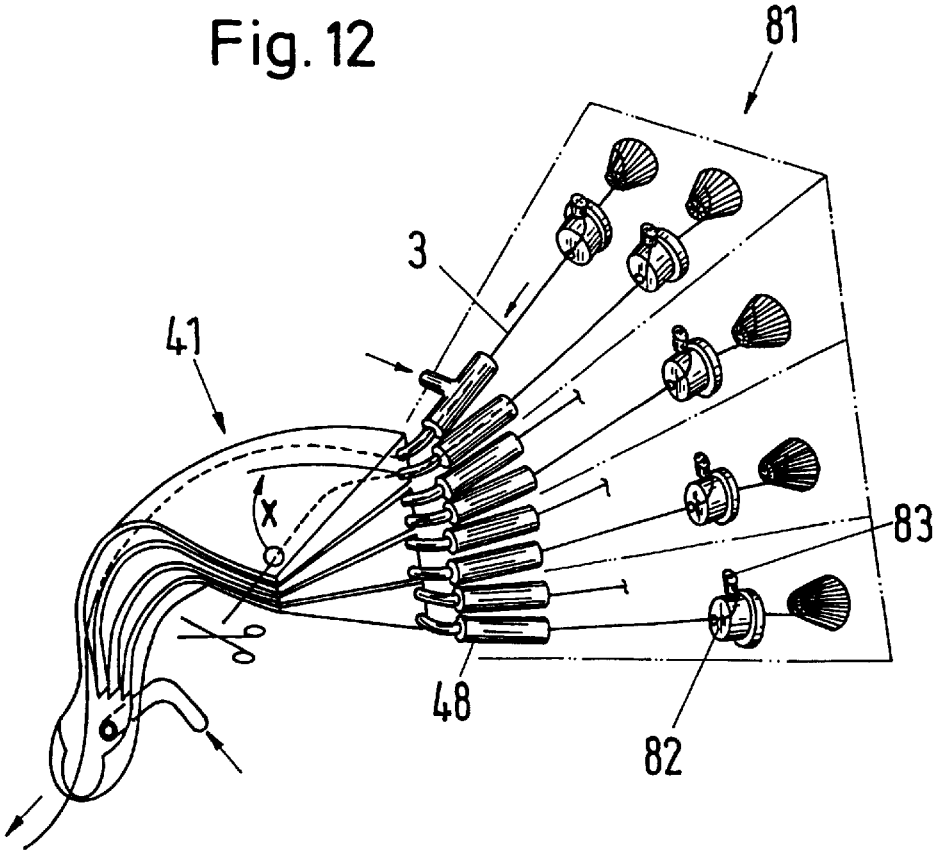

FIG. 12 shows a device 81 for the discontinuous, i.e. selective supplying of weft threads 3 with a thread storage 82 for each nozzle 31, with the thread storage being provided with a thread stopping member 83.

The apparatus contains a stationary unit 4 having an arrangement 22 with a plurality of passages 26 and with a plurality of nozzles 31 for the supplying of weft threads 3 and a unit 5 which rotates with the weaving rotor 1 with a plurality of injector nozzles 12 which are intended to successively draw off the weft threads which are supplied to the passages and to feed them into the shed.

This apparatus ensures the insertion of weft threads of different kinds and embodiments.

What is claimed is:

1. An apparatus for the insertion of weft threads into a series shed weaving machine comprising a weaving rotor having weft insertion passages, said apparatus having a stationary unit with a plurality of passages and with a plurality of nozzles for the insertion of the weft threads and a unit which is arranged to rotate with the weaving rotor in order to feed the weft threads into the weft insertion passages, wherein the plurality of nozzles are provided at the unit which rotates with the weaving rotor in order to draw off the weft threads which are supplied to the passages and to insert them into the weft insertion passages.

2. An apparatus in accordance with claim 1 wherein a plurality of second nozzles are provided which are arranged at the stationary unit in order to forward the weft threads into the passages, with the weft threads of a supply unit being either continuously or discontinuously supplied to the second nozzles.

3. An apparatus in accordance with claim 1 wherein the stationary unit has a holder and an arrangement of passages with the passages forming an arch and being substantially concentrically arranged at the holder.

4. An apparatus in accordance with claim 1 wherein second units which form the passages and which are arranged in the manner of a fan are provided.

5. An apparatus in accordance with claim 1 wherein the passage comprises a transport passage and a draw-out passage.

6. An apparatus in accordance with claim 5 wherein the transport passage has an open width which is greater than the open width of the draw-out passage.

7. An apparatus in accordance with claim 1 wherein the passages are collected into a component, with each passage having at least one inlet and with all passages opening into a common outlet.

8. An apparatus in accordance with claim 7 wherein the component contains a number of second units; and wherein the component consists of a first section with the passages and a second section into which the passages open and which has an opening.

9. An apparatus in accordance with claim 7 wherein the passages are subdivided into groups; and wherein the component has at least one group of passages.

10. An apparatus in accordance with claim 1 wherein the passage has a cross-section which contracts in the direction towards the open longitudinal side.

11. An apparatus in accordance with claim 7 further comprising an auxiliary nozzle which is arranged into the second section of the component in such a manner that the opening of the auxiliary nozzle is directed towards the opening.

12. An apparatus in accordance with claim 1 wherein the plurality of nozzles are arranged at equal angular spacings on a common pitch circle.

13. A series shed weaving machine comprising an apparatus for the insertion of weft threads, and a weaving rotor having weft insertion passages, the apparatus having a stationary unit with a plurality of passages and with a plurality of nozzles for the insertion of the weft threads and a unit that is arranged to rotate with the weaving rotor in order to feed the weft threads into the weft insertion passages, wherein the plurality of nozzles are provided at the unit which rotates the weaving rotor in order to draw off the weft threads which are supplied to the passages and to insert them into the weft insertion passages.

* * * * *